US005267685A

United States Patent [19]

Sorensen

[11] Patent Number: 5,267,685

[45] Date of Patent: Dec. 7, 1993

[54] STACKABILITY OF HOLLOW PRODUCTS WITH CONICALLY CONTOURED SIDEWALLS HAVING LONGITUDINAL FOLDS

[75] Inventor: Jens O. Sorensen, Rancho Santa Fe, Calif.

[73] Assignee: Primtec, San Diego, Calif.

[21] Appl. No.: 22,141

[22] Filed: Feb. 25, 1993

[51] Int. Cl.[5] ..... B65D 3/04

[52] U.S. Cl. ..... 229/1.5 B; 220/673; 215/10

[58] Field of Search ..... 229/1.5 B; 215/10; 206/517, 518, 519; 220/212, 669, 673, 675; 428/156, 161, 163, 167

[56] References Cited

U.S. PATENT DOCUMENTS

| | | | |
|---|---|---|---|
| 2,799,435 | 7/1957 | Abplanalp . | |
| 2,805,790 | 9/1957 | Smucker | 229/1.5 B X |
| 2,961,123 | 11/1960 | Boydak et al. | 206/517 X |
| 3,001,683 | 9/1961 | Goodwin et al. | 220/669 X |
| 3,169,688 | 2/1965 | Schad | 229/1.5 |
| 3,169,689 | 2/1965 | Schwartz | 229/1.5 |
| 3,194,468 | 7/1965 | Baron | 229/1.5 |
| 3,215,300 | 11/1965 | Lynch | 206/519 X |
| 3,237,834 | 3/1966 | Davis et al. | 229/1.5 |
| 3,372,830 | 3/1968 | Edwards | 220/9 |
| 3,375,554 | 4/1968 | Blumer | 18/42 |
| 3,495,736 | 2/1970 | Ragettli | 229/1.5 B X |
| 3,679,119 | 7/1972 | Copping | 229/1.5 |
| 3,944,124 | 3/1976 | Hexel | 229/1.5 B |
| 4,082,184 | 4/1978 | Hammer | 206/519 |
| 4,111,303 | 9/1978 | Compton | 206/519 X |
| 4,124,120 | 11/1978 | Day | 206/519 |
| 4,140,828 | 2/1979 | Copping | 428/167 |
| 4,316,540 | 2/1982 | Lapham | 206/518 X |
| 4,657,141 | 4/1987 | Sorensen | 206/519 |
| 4,743,420 | 5/1988 | Dutt | 264/102 |
| 4,807,775 | 2/1989 | Sorensen | 220/72 |
| 4,846,350 | 7/1989 | Sorensen | 206/520 |
| 5,008,064 | 4/1991 | Sorensen | 264/308 |
| 5,125,512 | 6/1992 | O'Leary | 229/1.5 B X |

FOREIGN PATENT DOCUMENTS

| | | |
|---|---|---|
| 1379371 | 1/1975 | United Kingdom . |
| 2061699 | 5/1981 | United Kingdom . |

*Primary Examiner*—Allan N. Shoap
*Assistant Examiner*—Christopher McDonald
*Attorney, Agent, or Firm*—Edward W. Callan

[57] ABSTRACT

A hollow stackable product including at least a section of a generally conically contoured sidewall having a number of longitudinal folds of alternating ridges and furrows. Each fold includes a first side strip laterally extending from the top of a ridge to the bottom of an adjacent furrow and a second side strip laterally extending from the bottom of the furrow to the top of the next adjacent ridge. The first side strip has a different lateral orientation than the second side strip. The first side strip has a greater wall thickness than the second side strip; and the first side strip also has a shorter lateral extent than the second side strip. When the product is stacked within a like product, a first product is placed inside a second like product so that the first side strips of the first product are positioned closely adjacent the first side strips of the second product and the second side strips of the first product are positioned closely adjacent the second side strips of the second product. Accordingly such products have a minimal stacking height.

6 Claims, 2 Drawing Sheets

FIG. 1
PRIOR ART
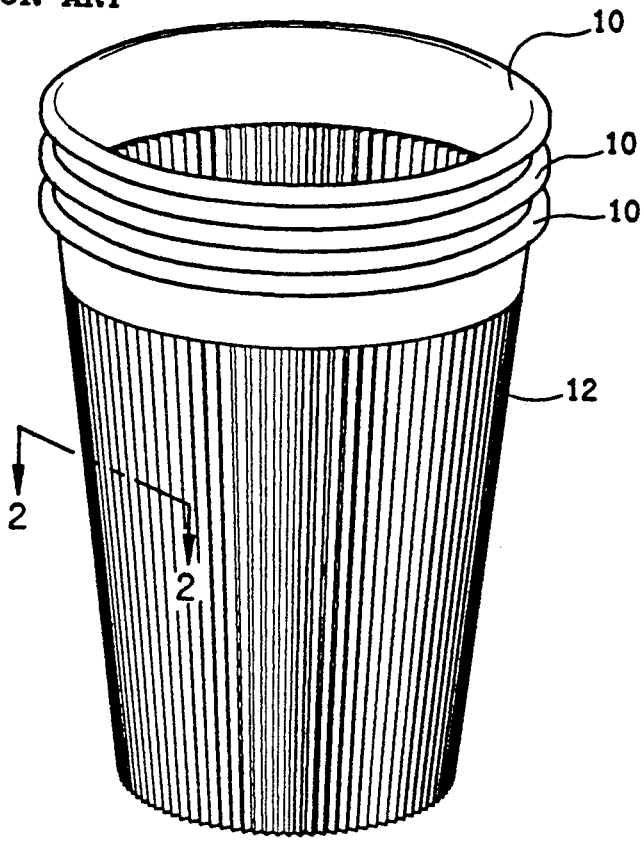
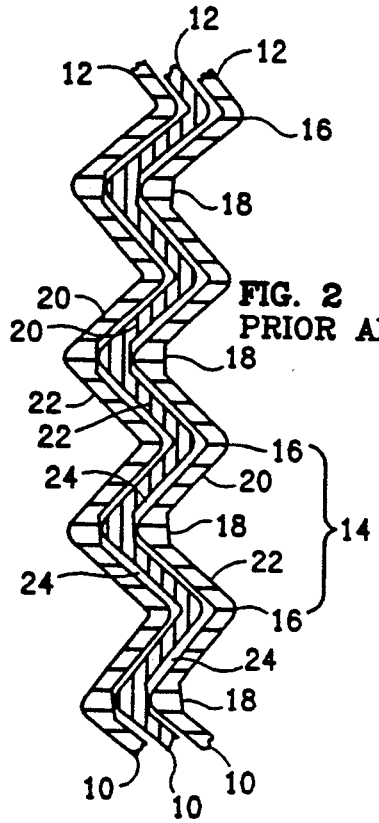
FIG. 2
PRIOR ART
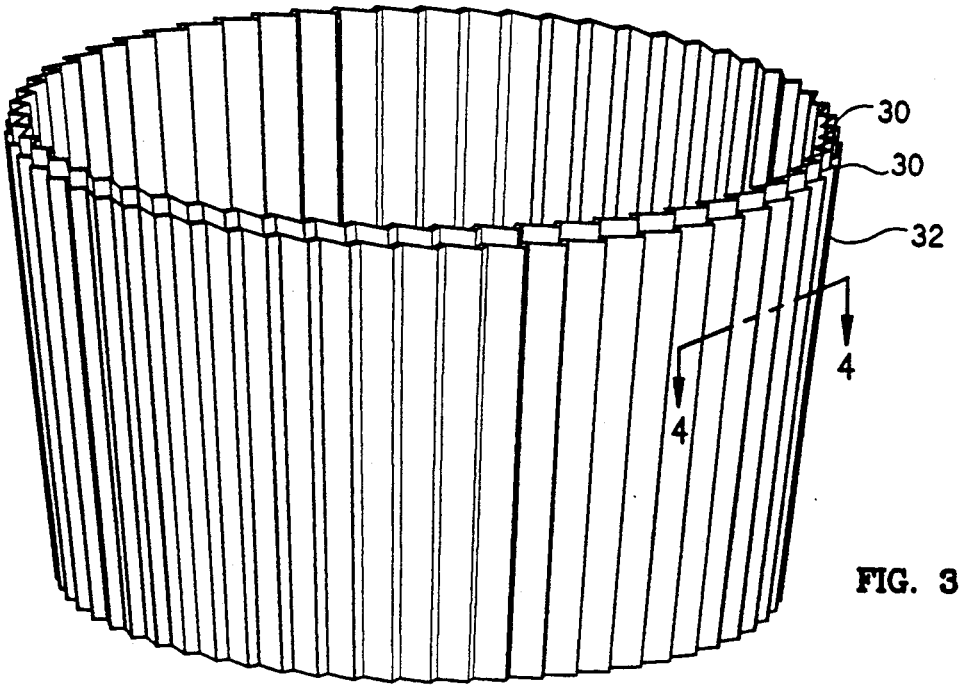
FIG. 3

STACKABILITY OF HOLLOW PRODUCTS WITH CONICALLY CONTOURED SIDEWALLS HAVING LONGITUDINAL FOLDS

BACKGROUND OF THE INVENTION

The present invention generally pertains to the stackability of hollow products and is particularly directed to an improvement in the stackability of hollow products of the type that includes at least a section of a generally conically contoured sidewall having a varying wall thickness and a number of longitudinal folds of alternating ridges and furrows. The longitudinal folds enhance the stiffness of such hollow stackable products and the variation in wall thickness may reduce the required injection pressure and clamp force when the product is manufactured by an injection molding process.

A prior art product of this type, as described in U.S. Pat. No. 3,194,468, is illustrated in FIGS. 1 and 2, which show three cups 10 stacked together with one cup stacked within a second cup which is stacked within a third cup. Each cup 10 has a generally conically contoured sidewall 12 having a number of longitudinal folds 14 of alternating ridges 16 and furrows 18. Each fold 14 includes a first side strip 20 laterally extending from the top of a ridge 16 to the bottom of an adjacent furrow 18 and a second side strip 22 laterally extending from the bottom of the furrow 18 to the top of the next adjacent ridge 16. The first side strips 20 have a different lateral orientation than the second side strips 22. The wall thickness at the bottom of the furrows 18 is greater than the wall thickness of the first and second side strips 20, 22.

When the cups 10 are stacked within one another, as shown in FIGS. 1 and 2, the cups 10 contact each other at the furrows 18, which have the greater wall thickness, such that there is a substantial space 24 between the first side strips 20 and/or between the second side strips 22 of the adjacent cups 10. Consequently, the stacking height of the cups 10 is greater than it would be if there was not a substantial space 24 between the first side strips 20 and/or between the second side strips 22 of the adjacent stacked cups 10. The stacking height of a product is the difference in height between the top of the product when stacked within a like product and the top of the like product. The stacking height of a product is approximately inversely proportional to the quantity of the product that can be stacked within a container of a given size.

SUMMARY OF THE INVENTION

The present invention provides a hollow stackable product including at least a section of a generally conically contoured sidewall having a number of longitudinal folds of alternating ridges and furrows, wherein each product is of such configuration that the products can be stacked within one another without there being a substantial space between the side strips of adjacent stacked products, whereby the stacking height of such products is minimized.

The hollow stackable product of the present invention comprises at least a section of a generally conically contoured sidewall having a number of longitudinal folds of alternating ridges and furrows, with each fold including a first side strip laterally extending from the top of a said ridge to the bottom of a said furrow; and a second side strip laterally extending from the bottom of the said furrow to the top of a said ridge next to the said ridge; wherein the first side strip has a different lateral orientation than the second side strip; and wherein the first side strip has a greater wall thickness than the second side strip.

The present invention further provides a stack of at least two like said hollow stackable products, such that when a first said product of two like said products is placed in the second said product, a said first side strip of the first product may be positioned closely adjacent a said first side strip of the second product and a said second side strip of the first product may be positioned closely adjacent a said second side strip of the second product.

Additional features of the present invention are described with reference to the detailed description of the preferred embodiments.

BRIEF DESCRIPTION OF THE DRAWING

FIG. 1 is a perspective illustration of a stack of prior art hollow stackable products of the type that have a conically contoured sidewall having a number of longitudinal folds of alternating ridges and furrows.

FIG. 2 is an enlarged sectional view of the side walls of the stacked prior art products shown in FIG. 1, taken along lines 2—2.

FIG. 3 is a perspective illustration of a stack of hollow stackable products according to one preferred embodiment of the present invention.

DETAILED DESCRIPTION

Figure 4:
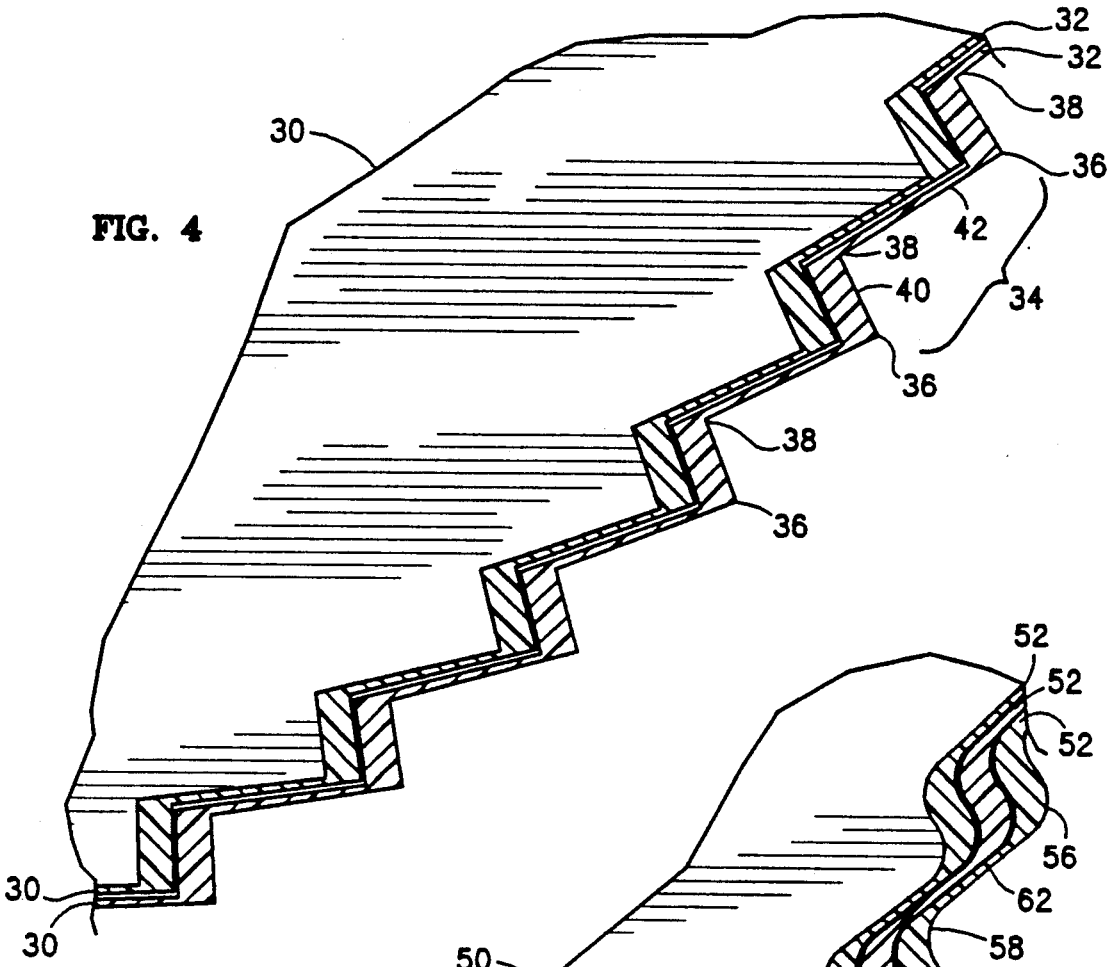
FIG. 4 is an enlarged sectional view of the side walls of the stacked products shown in FIG. 3, taken along lines 4—4.

A stack of one preferred embodiment of hollow stackable products 30 according to the present invention is shown in FIGS. 3 and 4, which illustrates a first product 30 stacked within a like second product 30. Each product 30 includes a conically contoured sidewall 32 having a number of longitudinal folds 34 of alternating ridges 36 and furrows 38. Each fold includes a first side strip 40 laterally extending from the top of a ridge 36 to the bottom of an adjacent furrow 38 and a second side strip 42 laterally extending from the bottom of the furrow 38 to the top of the next adjacent ridge 36. The first side strips 40 have a different lateral orientation than the second side strips 42; and the first side strips also have a shorter lateral extent than the second side strips 42. In other preferred embodiments (not shown) the first side strips do not have a shorter lateral extent than the second side strips 42.

The first side strips 40 have a greater wall thickness than the second side strips 42. As a result, the first product 30 may be placed inside the second product 30 so that the first side strips 40 of the first product 30 are positioned closely adjacent the first side strips 40 of the second product 30 and the second side strips 42 of the first product 30 are positioned closely adjacent the second side strips 42 of the second product 30, as shown in FIG. 4. Accordingly, the products 30 have a shorter stacking height than the prior art products.

Figure 5:
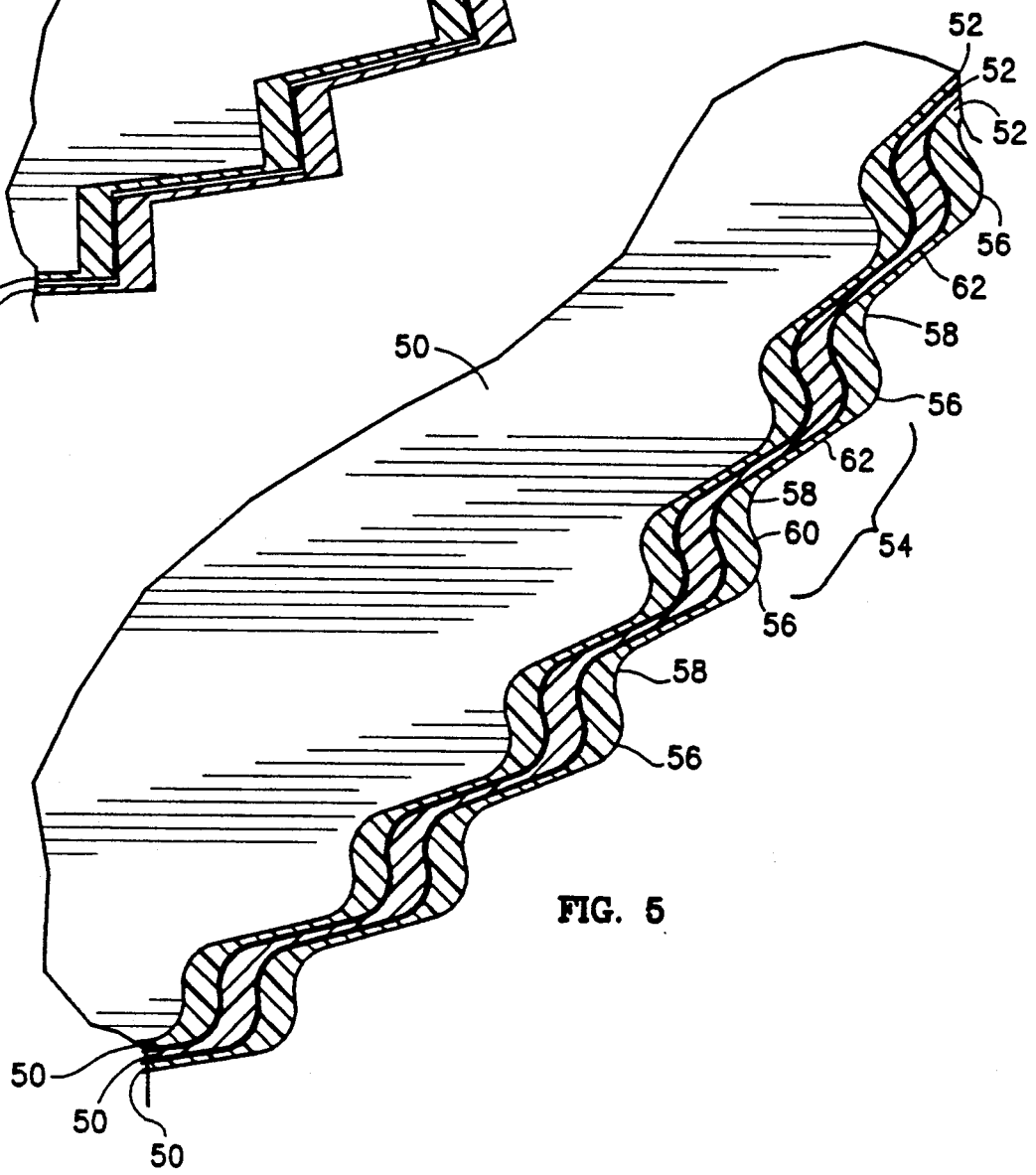
FIG. 5 is an enlarged sectional view of the side walls of stacked hollow stackable products according to an alternative preferred embodiment of the present invention.

An alternative preferred embodiment of the product 50 of the present invention is illustrated in FIG. 5, which shows the side walls 52 of three stacked products 50. The stacked products 50 are of the same configuration as the stacked products 30 shown in FIGS. 3 and 4, except that the stacked products 50 have folds 54 of alternating ridges 56 and furrows 58 that are rounded, whereas the ridges 36 and furrows 38 of the products 30 have sharp edges.

The present invention is also applicable to products of like generic design including at least a section of a generally conically contoured sidewall having a number of longitudinal folds that include combinations of sharp and rounded ridges and/or furrows, or ridges and/or furrows having other contours, provided that the first side strips have a greater wall thickness than the second side strips. the cross section of the side wall is not necessarily generally circular, as shown in FIGS. 3 and 4, but may for example alternatively be of a generally polygonal shape with generally rounded side segments.

I claim:

1. A hollow stackable product, comprising at least a section of a generally conically contoured sidewall having a number of longitudinal folds of alternating ridges and furrows, each fold including a first side strip laterally extending from the top of a said ridge to the bottom of a said furrow; and a second side strip laterally extending from the bottom of the said furrow to the top of a said next to the said ridge;

wherein the first side strip has a different lateral orientation than the second side strip; and wherein the first side strip has a greater wall thickness than the second side strip.

2. A product according to claim 1, wherein when a first said product of two like said products is placed in the second said product, a said first side strip of the first product may be positioned closely adjacent a said first side strip of the second product and a second side strip of the first product may be positioned closely adjacent a said second side strip of the second product.

3. A product according to claim 2, wherein the first side strip has a shorter lateral extent than the second side strip.

4. A product according to claim 1, wherein the first side strip has a shorter lateral extent than the second side strip.

5. A stack of at least two like products, each product comprising at least a section of a generally conically contoured sidewall having a number of longitudinal folds of alternating ridges and furrows, each fold including a first side strip laterally extending from the top of a said ridge to the bottom of a said furrow; and a second side strip laterally extending from the bottom of the said furrow to the top of a said ridge next to the said ridge;

wherein the first side strip has a different lateral orientation than the second side strip; and wherein the first side strip has a greater wall thickness than the second side strip; and wherein a first product of said like products is disposed in a second product of said like products; and wherein a said first side strip of the first product is positioned closely adjacent a said first side strip of the second product and a said second side strip of the first product is positioned closely adjacent a said second side strip of the second product.

6. A stack of products according to claim 5, wherein the first side strip has a shorter lateral extend than the second side strip.

* * * * *